US010634165B2

(12) United States Patent
Mehlhorn

(10) Patent No.: US 10,634,165 B2
(45) Date of Patent: Apr. 28, 2020

(54) PUMPING APPARATUS HAVING A FLOW GUIDING ELEMENT

(71) Applicant: Sulzer Management AG, Winterthur (CH)

(72) Inventor: Steve Mehlhorn, Zurich (CH)

(73) Assignee: SULZER MANAGEMENT AG, Winterthur (CH)

( * ) Notice: Subject to any disclaimer, the term of this patent is extended or adjusted under 35 U.S.C. 154(b) by 163 days.

(21) Appl. No.: 14/649,459

(22) PCT Filed: Nov. 26, 2013

(86) PCT No.: PCT/EP2013/074664
§ 371 (c)(1),
(2) Date: Jun. 3, 2015

(87) PCT Pub. No.: WO2014/090559
PCT Pub. Date: Jun. 19, 2014

(65) Prior Publication Data

US 2015/0300371 A1 Oct. 22, 2015

(30) Foreign Application Priority Data

Dec. 14, 2012 (EP) ..... 12197150

(51) Int. Cl.
*F04D 29/54* (2006.01)
*F04D 29/42* (2006.01)
(Continued)

(52) U.S. Cl.
CPC ..... *F04D 29/54* (2013.01); *F04D 3/005* (2013.01); *F04D 19/002* (2013.01);
(Continued)

(58) Field of Classification Search
CPC ..... F04D 19/004; F04D 29/54; F04D 3/005; F04D 19/002; F04D 29/181; F04D 29/32;
(Continued)

(56) References Cited

U.S. PATENT DOCUMENTS 1,536,754 A * 5/1925 Benson ..... F04D 3/005 384/441
1,945,071 A * 1/1934 Popp ..... F03B 15/12 415/32
(Continued)

FOREIGN PATENT DOCUMENTS

CN 1542290 A 11/2004
CN 101949393 A 1/2011
(Continued)

OTHER PUBLICATIONS

Chinese Search Report dated Aug. 5, 2016 in CN Application No. 201380062488.4 (English Translation Only).
(Continued)

*Primary Examiner* — Woody A Lee, Jr.
*Assistant Examiner* — Brian Christopher Delrue
(74) *Attorney, Agent, or Firm* — Global IP Counselors, LLP

(57) ABSTRACT

A pumping apparatus includes an impeller, an inlet housing and at least one flow guiding element. The impeller is rotationally supported for the guidance of a pumpable medium about an axis of rotation. The inlet housing spans a suction region upstream of the impeller. The at least one flow guiding element is at least partly arranged within the suction region and the flow guiding element is provided to guide the medium flow in the direction of the impeller.

12 Claims, 3 Drawing Sheets

(51) Int. Cl.

| | |
|---|---|
| ***F04D 29/68*** | (2006.01) |
| ***F04D 29/44*** | (2006.01) |
| ***F04D 3/00*** | (2006.01) |
| ***F04D 19/00*** | (2006.01) |
| ***F04D 29/18*** | (2006.01) |
| ***F04D 29/32*** | (2006.01) |
| ***F04D 29/64*** | (2006.01) |

(52) U.S. Cl.
CPC ..... *F04D 29/181* (2013.01); *F04D 29/32* (2013.01); *F04D 29/4273* (2013.01); *F04D 29/448* (2013.01); *F04D 29/64* (2013.01); *F04D 29/688* (2013.01)

(58) Field of Classification Search
CPC .... F04D 29/4273; F04D 29/448; F04D 29/64; F04D 29/688; F04D 29/70; F04D 29/701; F04D 29/703; F04D 29/708
USPC ..... 415/191, 208.1, 208.2, 182.1, 183–185, 415/189, 193, 209.2, 209.3
See application file for complete search history.

(56) References Cited

U.S. PATENT DOCUMENTS 2,554,601 A * 5/1951 Sutton ..... F04D 29/646 415/121.2
2,554,602 A * 5/1951 Sutton ..... F04D 29/545 29/511
2,593,217 A * 4/1952 Sutton ..... F04D 29/646 108/50.13
2,603,468 A * 7/1952 Sutton ..... F04D 29/705 261/104
2,641,191 A * 6/1953 Buchi ..... F04D 29/2272 415/186
2,805,820 A * 9/1957 Evarts ..... F04D 29/646 211/1.3
3,411,451 A 11/1968 Heinz-Bernd et al.
3,667,860 A * 6/1972 Endress et al. ..... F04D 27/0253 415/149.1
4,249,428 A * 2/1981 Herron ..... F16H 53/06 112/459
4,643,639 A * 2/1987 Caine ..... F04D 29/468 277/412
4,650,342 A * 3/1987 Goodwin ..... B01F 7/00733 366/264
4,917,577 A * 4/1990 Stirling ..... B01F 3/04617 261/93
4,927,324 A * 5/1990 Coup ..... F04D 25/08 415/121.2
5,179,862 A * 1/1993 Lynnworth ..... G01F 1/662 73/861.28
6,439,085 B1 * 8/2002 Habermehl ..... B25B 23/00 81/434
7,530,783 B1 * 5/2009 Ediger ..... F04D 29/646 415/121.2
7,856,834 B2 * 12/2010 Haley ..... F04D 17/122 62/115
8,424,566 B2 * 4/2013 Merchant ..... F01K 9/003 137/565.17
8,579,582 B1 * 11/2013 Gehring ..... F04D 25/08 415/182.1
9,297,385 B2 * 3/2016 Yamanaka ..... F04D 13/08
9,353,765 B2 * 5/2016 Haley ..... F04D 29/4213
2001/0018023 A1 * 8/2001 Tagomori ..... F04D 29/4273 415/220
2001/0021344 A1 * 9/2001 Miyamoto ..... F04D 29/667 415/119
2003/0024233 A1 * 2/2003 Snyder ..... B01D 45/08 60/39.092
2004/0094662 A1 * 5/2004 Sanders, Jr. ..... B64C 27/20 244/12.5
2009/0099737 A1 * 4/2009 Wendte ..... A01B 79/005 701/50
2010/0135765 A1 * 6/2010 Burgess ..... F04D 7/04 415/1
2011/0030821 A1 * 2/2011 Merchant ..... F01K 9/003 137/565.01
2014/0140861 A1 * 5/2014 Pellenc ..... E01H 1/0809 417/44.1
2014/0363273 A1 * 12/2014 Burman ..... F04D 3/02 415/97
2016/0131157 A1 * 5/2016 Burman ..... F04D 29/181 415/208.2

FOREIGN PATENT DOCUMENTS

EP 0244082 A2 11/1987
JP 2010-138765 A 6/2010

OTHER PUBLICATIONS

International Search Report and Written Opinion dated Jul. 22, 2014 in International Application No. PCT/EP2013/074664, filed Nov. 26, 2013 (with partial English translation).

* cited by examiner

PUMPING APPARATUS HAVING A FLOW GUIDING ELEMENT

CROSS-REFERENCE TO RELATED APPLICATIONS

This application is a U.S. National stage application of International Application No. PCT/EP2013/074664, filed Nov. 26, 2013, which claims priority to EP Patent Application 12197150.1, filed Dec. 14, 2012, the contents of each of which are hereby incorporated herein by reference.

BACKGROUND

Field of the Invention

The invention relates to a pumping apparatus having a flow guiding element.

Background Information

From EP 0 985 098 B1 a pumping apparatus is already known including an impeller which is rotatably stored for the guidance of a pumpable medium about an axis of rotation, including an inlet housing which spans a suction region upstream of the impeller and including a flow guiding element at least partly arranged within the suction region, which flow guiding element is provided to guide the medium flowing in the direction of the impeller.

SUMMARY

The invention is, in particular based on the object to improve a running smoothness of a pump, in particular on accelerating and on decelerating. It is satisfied by a pumping apparatus in accordance with the invention according to the independent claims. Embodiments of the invention result from the dependent claims.

The invention starts from a pumping apparatus, including an impeller which is rotatably stored for the guidance of a pumpable medium about an axis of rotation, including an inlet housing, which spans a suction region upstream of the impeller and including one flow guiding element at least partly arranged within the suction region which flow guiding element is provided to guide the medium flowing in the direction of the impeller, this means to prevent a possibly present recirculation and/or to separate the medium from a main flow.

It is suggested that the at least one flow guiding element is configured at least partly in the shape of a ring segment. Thereby, a flow profile can be improved in the suction region, whereby a stability of the pump characteristic line of the pump can be improved. By means of this stable characteristic line it is achieved that an unambiguous point of operation can be determined, this means that a defined conveying head pressure can unambiguously be associated with a defined feed amount. Thereby, it can be achieved that, on an acceleration of the pump or on a switching off of the pump, the pump performance continuously increases or continuously decreases, whereby, in particular instabilities in the flow profile can be avoided. Through the avoidance of instabilities in the flow profile in turn a higher running smoothness of the pump can be achieved. Through an embodiment in accordance with the invention thus, in particular on an acceleration or a switching off of a pump, a running smoothness can be improved. An "impeller" should, in particular in this connection be understood as a propeller running within a pump region spanned by the inlet housing for the guidance of the pumpable medium A "pumpable medium" should, in particular be understood as a fluid medium having a viscosity smaller than 50 mm2s-1, preferably smaller than 25 mm2s-1 and preferably smaller than 5 mm2s-1. A "flow guiding element for the guidance of medium flowing in the direction of the impeller" should, in particular be understood such that the medium flows at both sides of the flow guiding element in the direction of the impeller during operation. It should, in particular be understood that the flow guiding element does not form a passage or the like, which is provided to branch off a part of the medium to be conveyed, such as, for example, a bypass passage or a return passage guided past the impeller in which a part of the medium flows against the feed direction. A flow guiding element in the shape of a "ring segment" should, in particular be understood such that the flow guiding element in at least a part region has an outwardly facing and/or inwardly facing curvature with respect to the axis of rotation of the impeller, which curvature is at least substantially the same size over the overall part region. "At least substantially the same size" should, in particular be understood such that the curvature in the individual points of the part region deviates by at most 10%, preferably by at most 5% and particularly preferably by at most 1%. "At least partially in the shape of a ring segment" should, in particular be understood such that the flow element is configured having the shape of a ring segment in the part region or as a ring. "Provided" should, in particular be understood as configured and/or adapted for.

It is further suggested that the flow guiding element is arranged coaxial with respect to the axis of rotation. Thereby, a particularly advantageous arrangement of the flow guiding element can be provided for the flow profile. "Arranged coaxial with respect to the axis of rotation" should in this connection, in particular be understood such that the at least one flow guiding element has at least the shape of a ring segment, in particular with respect to the axis of rotation of the impeller.

In an embodiment of the invention it is suggested that the pumping apparatus has a minimum and/or a maximum spacing between the inlet housing and the at least one flow guiding element which spacing is at most the same size as a radius of curvature of the flow guiding element. Thereby, the flow guiding element is arranged with respect to the inlet housing having a sufficiently small spacing in order to positively influence the flow profile. Preferably, the minimum spacing and the maximum spacing are smaller than the radius of curvature of the flow guiding element.

Particularly advantageously the flow guiding element has a radius of curvature which is smaller than a maximum radius at the inlet of the impeller. Thereby, the flow profile can be further improved. Preferably, the flow guiding element is smaller than the radius of the impeller with respect to its radius of curvature by at least 10%.

It is further suggested that the flow guiding element is configured as a sheet metal component. Thereby, the flow guiding element can be configured particularly simple from a construction point of view. Generally, however, also a design from a different material, for example, a plastic is plausible, preferably in the shape of a sheet metal component, this means having an at least substantially constant thickness, wherein the thickness of the flow guiding element is slightly smaller than a head pressure and extends in a longitudinal direction in the circumferential direction. "A thickness" should in this connection, in particular be understood as a dimension in a direction which extends in a radial direction with respect to the radius of curvature of the flow guiding element. A "head pressure" should, in particular be understood as a dimension in a direction which extends in parallel to the radius of curvature of the flow guiding element with respect to an axis for the determination of the radius of curvature.

Preferably, the flow guiding element has a head pressure directed along an axis of rotation of the impeller, the head pressure being significantly smaller than a radius of curvature of the flow guiding element. Thereby, the head pressure of the flow guiding element is substantially smaller than the radius of curvature, whereby a compact design can be achieved without the flow profile being disadvantageously influenced thereby. "Substantially smaller" should, in particular be understood such that the head pressure is at most 50% of the radius of curvature, preferably at most 40% of the flow guiding element, particularly preferably at most 25% of the radius of curvature.

Particularly preferably the flow guiding element is configured in the shape of a cylinder jacket surface. Thereby, a particularly simple design can be achieved from a construction point of view.

It is further suggested that the inlet housing has a suction nozzle formed upstream of the impeller from a flow point of view, in which suction nozzle the at least one flow guiding element is at least partly arranged. Thereby, the flow profile is also advantageously influenced by the inlet housing, whereby, in particular, in connection with the at least one flow guiding element, a characteristic line for the efficiency of the pump can be achieved which has an unambiguous dependency between the pump performance and the drive power.

In a further embodiment of the invention it is suggested that the inlet housing has at least one constantly tapering part region for the formation of the suction nozzle, in which part region the flow guiding element is at least partly arranged. For such an arrangement, the flow guiding element, which preferably, in particular influences a flow profile in an outer region, brings about a particularly advantageous flow profile in the suction nozzle. Thereby, in particular instabilities in the flow profile can be particularly advantageously avoided, whereby critical regions in the pump characteristic line can advantageously be avoided.

Preferably, the inlet housing has a constriction upstream of the impeller, in which constriction the at least one flow guiding element is at least partly installed. Thereby, an advantageous flow profile can be achieved in the constriction. "A constriction" should, in particular in this connection be understood as a cross-sectional plane, in which the suction region spanned by the inlet housing should have a minimum cross-sectional area. "Installed in the constriction" should, in particular be understood such that the at least one flow guiding element passes through the constriction.

It is further suggested that the at least one flow guiding element and the inlet housing have a constant spacing in at least one cross-sectional plane perpendicular with respect to the axis of rotation of the impeller. For such an embodiment the at least one flow guiding element has a form adapted to the form of the inwardly directed wall of the inlet housing, whereby an advantageous flow profile can be achieved over the overall circumference of the flow guiding element. "In at least one cross-sectional plane" should in this connection, in particular be understood such that the spacing of a cross-sectional plane is constant over the overall circumference of the flow guiding element; however, in different cross-sectional planes can have a different size. A "spacing" should, in particular be understood as a spacing between an outer wall of the flow guiding element and an inner wall of the inlet housing in the corresponding cross-sectional plane. "Constant" should, in particular be understood such that the spacing has the same size over the overall circumference having a tolerance equal to at most ±5%, preferably equal to ±2% and particularly preferably equal to ±1%.

It is further suggested that the pumping apparatus has at least one fastening element which connects the flow guiding element to the inlet housing. Thereby, a particularly simple attachment of the flow guiding element can be realized.

Preferably, at least one fastening element has at least one extension, the at least one extension extends substantially in the radial direction with respect to the axis of rotation of the impeller. Thereby, it can be avoided that the fastening element significantly influences the flow profile.

Moreover, a pump having a pumping apparatus in accordance with the invention is suggested which is preferably configured as a vertical pump, in which the medium to be conveyed is guided in a feed direction perpendicular to a gravitational force acting on the medium to be conveyed. In particular, a critical region in the characteristic line has an influence on a running smoothness of the pump for such pumps, whereby, in particular a pumping apparatus in accordance with the invention is, in particular advantageous for such pumps.

Further advantages result from the following description of the Figures. In the Figures three embodiments of the invention are illustrated. The Figures, the description of the Figures and the claims include numerous features in combination. The person skilled in the art will expediently also consider these features individually and combine these to further suitable combinations.

BRIEF DESCRIPTION OF THE DRAWINGS

Referring now to the attached drawings which form a part of this original disclosure.

DETAILED DESCRIPTION OF EMBODIMENTS

Figure 1:
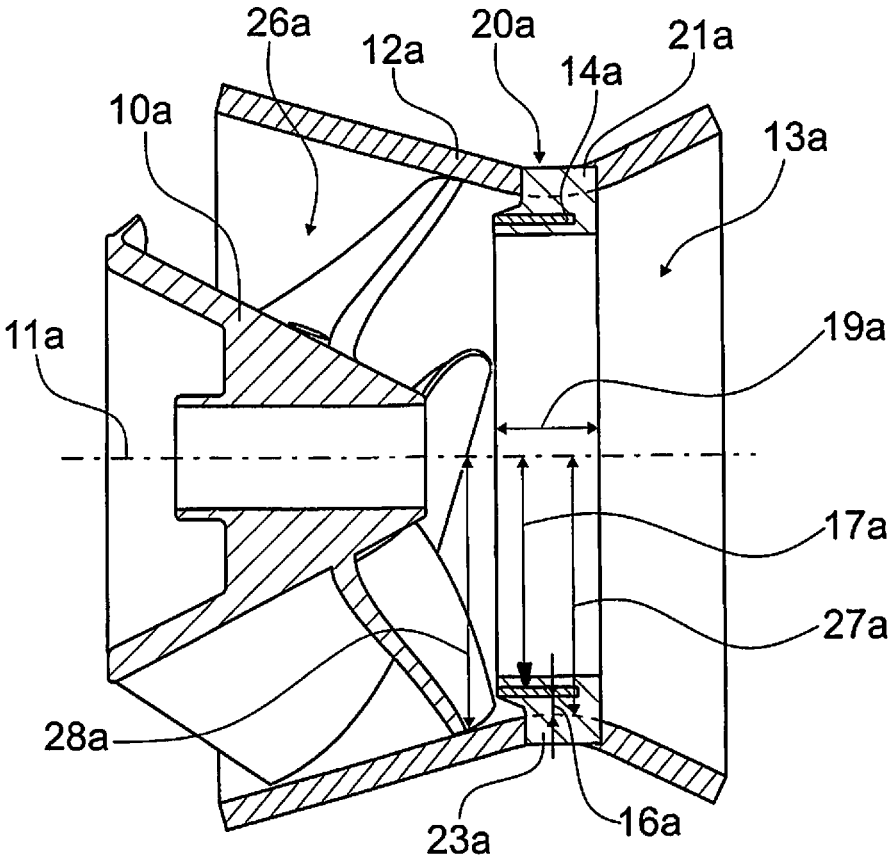
FIG. 1 is a cross-section through an inlet housing of a pumping apparatus in accordance with the invention.
Figure 2:
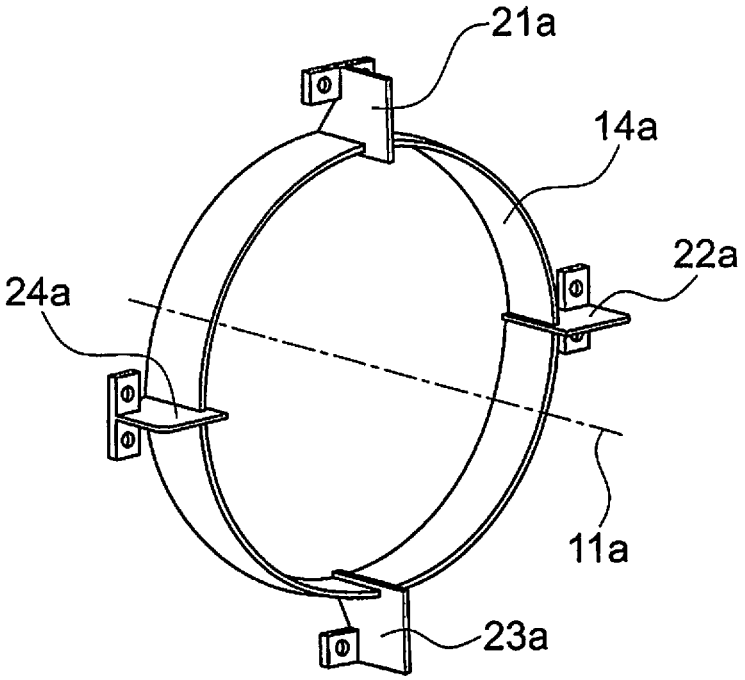
FIG. 2 is a flow guiding element of the pumping apparatus in a perspective view.
Figure 3:
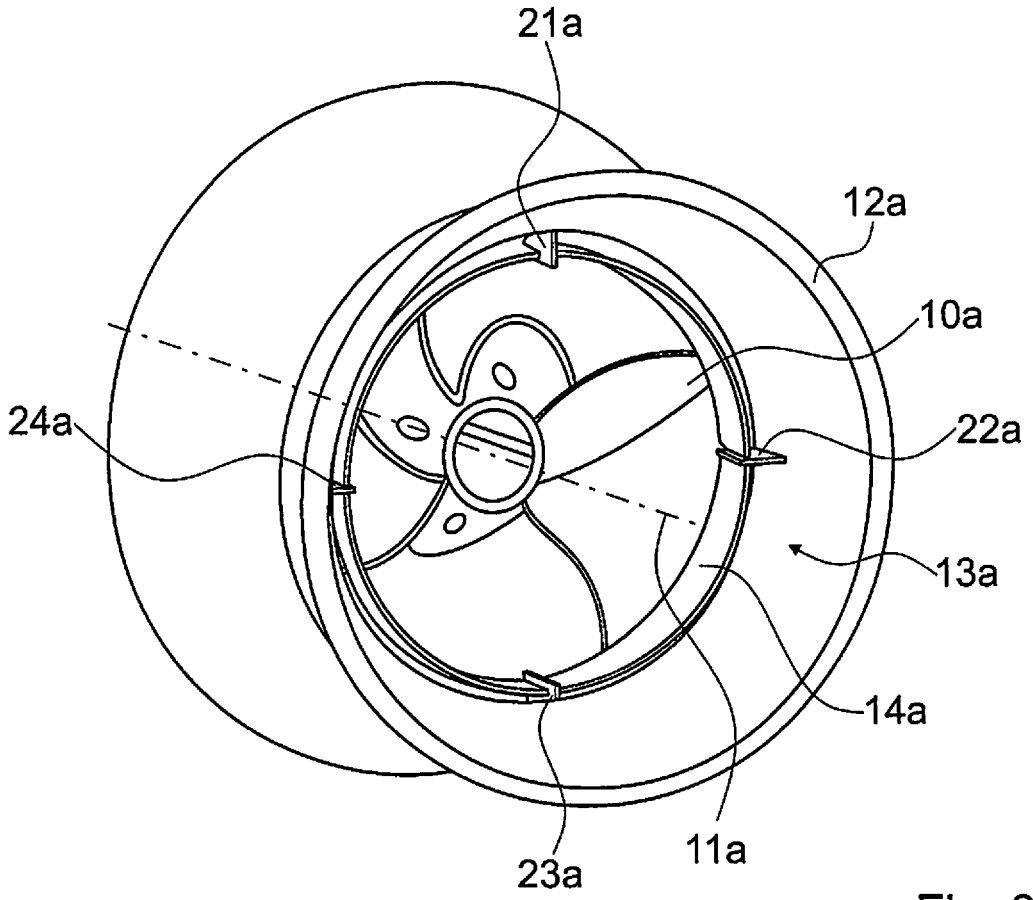
FIG. 3 is a perspective illustration of the pumping apparatus.
Figure 4:
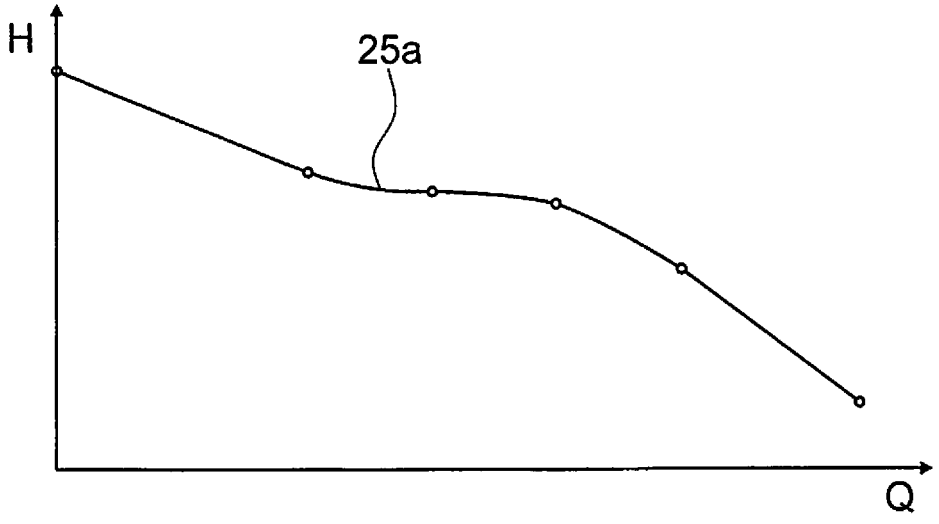
FIG. 4 is a characteristic line of the pump performance of the pumping apparatus.

The FIGS. 1 to 3 show a pumping apparatus for a pump. FIG. 4 shows a characteristic line 25*a* in which a feed head pressure H is applied with respect to a feed amount Q of a pump. The pumping apparatus includes an inlet housing 12*a* and an impeller 10*a* which is arranged within the inlet housing 12*a*. The impeller 10*a* is provided to convey a pumpable medium, such as a liquid. The pump is configured as a vertical pump. The impeller 10*a*, which is rotatably supported, has an axis of rotation 11*a* which is preferably vertically oriented during operation, this means that the axis of rotation 11*a* of the impeller 10*a* extends in parallel to a gravitational force, against which the pump sucks the medium. A drive is not illustrated in detail which is included in the pump in order to drive the impeller 10*a*. The pump is provided for very large pump volumes, for example at an order of magnitude of approximately 50,000 $m^3/h$ for a low feed head pressure, for example, between 10 m and 40 m.

The inlet housing 12*a* spans a suction region 13*a* which is switched upstream of the impeller 10*a*. Moreover, the inlet housing 12*a* partly spans a pump region 26*a* in which the impeller 10*a* is arranged. The pump is provided to be immersed into a liquid, up until a liquid level within the inlet housing 12*a* is above the impeller 10*a*, whereby the impeller 10*a* immersed into the liquid can suck the medium and convey this. The inlet housing 12*a* deflects the medium to be pumped in the direction of the impeller 10*a*. A flow profile which is set within the suction area 13*a*, in particular depends on a shape of the inlet housing 12*a*.

In order to influence the flow profile of the medium flowing within the suction region 13*a* in the direction of the impeller 10*a*, the pumping apparatus includes a flow guiding element 14*a*. The flow guiding element 14*a* is arranged within the suction region 13*a*. The flow guiding element 14*a* is configured in the shape of a ring which is arranged within the inlet housing 12*a*. For fastening the flow guiding element 14*a* at the inlet housing 12*a*, the pumping apparatus has a plurality of fastening elements 21*a*, 22*a*, 23*a*, 24*a*. The fastening elements 21*a*, 22*a*, 23*a*, 24*a* divide the flow guiding element 14*a* into segments which respectively have the shape of a ring segment. In the illustrated embodiment the fastening apparatus includes the four fastening elements 21*a*, 22*a*, 23*a*, 24*a*. Principally, however, also a different number of fastening elements 21*a*, 22*a*, 23*a*, 24*a* are plausible.

The flow guiding element 14*a* is arranged coaxial with respect to the axis of rotation 11*a* of the impeller 10*a*. The flow guiding element 14*a* has a middle point lying at the axis of rotation 11*a* via which middle point a radius of curvature 17*a* of the flow guiding element 14*a* can be defined with respect to the axis of rotation 11*a* of the impeller 10*a*. In the illustrated embodiment, in which the flow guiding element 14*a* is configured in the shape of a ring, the middle point defined by the radius of curvature 17*a* corresponds to a geometric middle point.

The inlet housing 12*a* in the region, in which the flow guiding element 14*a* is arranged, has an internal radius of curvature 27*a* with respect to the axis of rotation 11*a* of the impeller 10*a* which is larger than the radius of curvature 17*a* of the flow guiding element 14*a*. The flow guiding element 14*a* and the inlet housing 12*a* have a spacing 16*a* with respect to the axis of rotation 11*a* which is smaller than the radius of curvature 17*a* of the flow guiding element 14*a*. The spacing 16*a* is in this connection smaller than the radius of curvature over a total head pressure 19*a* of the flow guiding element 14*a*.

In the illustrated embodiment the internal radius of curvature 27*a* of the inlet housing 12*a* is larger by approximately a factor of 1.05 to 1.2 times the radius of curvature 17*a* of the flow guiding element 14*a*, this means that the spacing 16*a* between the flow guiding element 14 and the inlet housing 12*a* amounts to less than 20% of the radius of curvature 17*a* of the flow guiding element 14*a*. The spacing 16*a* between the flow guiding element 14*a* and the inlet housing 12*a* is thus substantially smaller than the radius of curvature 17*a* which the flow guiding element 14*a* has. The radius of curvature 17*a* of the flow guiding element 14*a*, for example, amounts to approximately 119 mm. The internal radius of curvature 27*a* of the inlet housing 12*a* amounts to approximately 135 mm.

The radius of curvature 17*a* of the flow guiding element 14*a* is moreover smaller than an outer radius 28*a* which the impeller 10*a* has (cf. FIG. 3). The outer radius 28*a* of the impeller 10*a*, this means the largest radius 28*a* definable at the impeller 10*a* at the inlet is approximately larger by a factor of 1.2 than the radius of curvature 17*a* of the flow guiding element 14*a*. In the illustrated embodiment the impeller 10*a* has a radius 28*a* of approximately 145 mm. An axial spacing between the impeller 10*a* and the flow guiding element 14*a* in the axial direction, this means along the axis of rotation 11*a*, is substantially smaller than the maximum radius 28*a* of the impeller 10*a*. A factor between the axial spacing and the maximum radius 28*a* of the impeller 10*a* amounts to approximately 0.04. Generally, however, also other dimensions of the impeller 10*a*, the inlet housing 12*a* and the flow guiding element 14*a* are plausible.

The flow guiding element 14*a* is configured as a single piece sheet metal component (cf. FIG. 2). The flow guiding element 14*a* has a head pressure 19*a* directed along the axis of rotation 11*a* of the impeller 10*a* which head pressure is substantially larger than a thickness which the flow guiding element 14*a* has in a direction radial with respect to the axis of rotation 11*a* of the impeller 10*a*. The thickness can, for example, lie in a range of a few millimeters or less, in contrast to which the head pressure 19*a* can amount to several centimeters. The thickness of the flow guiding element 14*a* is substantially constant over the overall circumference of the flow guiding element 14*a*. The flow guiding element 14*a* is configured in the shape of a cylinder jacket surface, whose head pressure 19*a* is smaller than its radius of curvature 17*a*.

The inlet housing 12*a* has a round internal cross-section in a cross-sectional plane perpendicular with respect to the axis of rotation 11*a*. Moreover, the inlet housing 12*a* is at least partly configured curved in the suction region 13*a* also along the axis of rotation 11*a* of the impeller 10*a*. A further internal radius of curvature can be defined for the inlet housing 12*a*, at least in the region in which the flow guiding element 14*a* is arranged, which further internal radius of curvature has a reference with respect to an axis perpendicular to the axis of rotation 11*a*. The inlet housing 12*a* in this connection preferably, but not necessarily, has a constantly tapering part region, and a constantly expanding part region. It is naturally understood that also a pure axial pump having a cylindrical inlet housing, this means with constant diameter is possible.

The inlet housing 12*a* forms a suction nozzle by its two curvatures which are switched upstream of the impeller 10*a* from a flow point of view. The flow guiding element 14*a* is arranged in the suction nozzle. The flow guiding element 14*a* is arranged partly in the constantly tapering part region and partly in the expanding part region along the axis of rotation 11*a* of the impeller 10*a*. The flow guiding element 14*a* extends from the tapering part region of the suction region 13*a* into the expanding part region.

The inlet housing 12*a* forms a constriction 20*a* whose internal diameter is smaller than a maximum diameter of the impeller 10*a*. At the constriction 20*a* the internal diameter of the inlet housing 12*a* is minimum. The flow guiding element 14*a* is installed in the constriction 20*a*. The spacing 16*a* between the inlet housing 12*a* and the flow guiding element 14*a* varies along the axis of rotation 11*a* of the impeller 10*a*. It becomes minimal in the region of the constriction 20*a*.

Since the flow guiding element 14*a* is configured ring-like and the inlet housing 12*a* has a round internal cross-section, the spacing 16*a* between the flow guiding element 14*a* and the inlet housing 12*a* is of equal size in each cross-sectional plane over the entire circumference of the flow guiding element 14*a*. With respect to a feed direction, along which the conveyed medium flows, the spacing 16*a* between the flow guiding element 14*a* and the inlet housing 12*a* upstream and downstream of the constriction 20*a* is larger than in the constriction 20*a*.

For fastening the flow guiding element 14*a* at the inlet housing 12*a* the pumping apparatus includes the four fastening elements 21*a*, 22*a*, 23*a*, 24*a*. The fastening elements 21*a*, 22*a*, 23*a*, 24*a* are likewise configured as sheet metal components. They have a radial direction of extent with respect to the axis of rotation 11*a* of the impeller 10*a*. They are arranged cross shaped with respect to the axis of rotation 11*a* of the impeller 10*a*. The fastening elements 21*a*, 22*a*, 23*a*, 24*a* and the flow guiding element 14*a* are configured as separate multi parts, however, are fixedly connected to one another. In the illustrated embodiment they are connected to one another in a material flow manner by means of a welded connection or a brazed connection. Principally, however, also a different type of connection between the fastening elements 21*a*, 22*a*, 23*a*, 24*a* and the flow guiding element 14*a* are plausible, such as, in particular also a shape matched and/or force matched connection, by means of clamps or screws. For a connection to the inlet housing 12*a*, the fastening elements 21*a*, 22*a*, 23*a*, 24*a* can respectively have bores, by means of which the fastening elements 21*a*, 22*a*, 23*a*, 24*a* can be screwed or riveted to the inlet housing 12*a*. Generally, however, also a different type of connection between the fastening elements 21*a*, 22*a*, 23*a*, 24*a* and the inlet housing 12*a* is plausible, such as, for example by welding.

Figure 5:
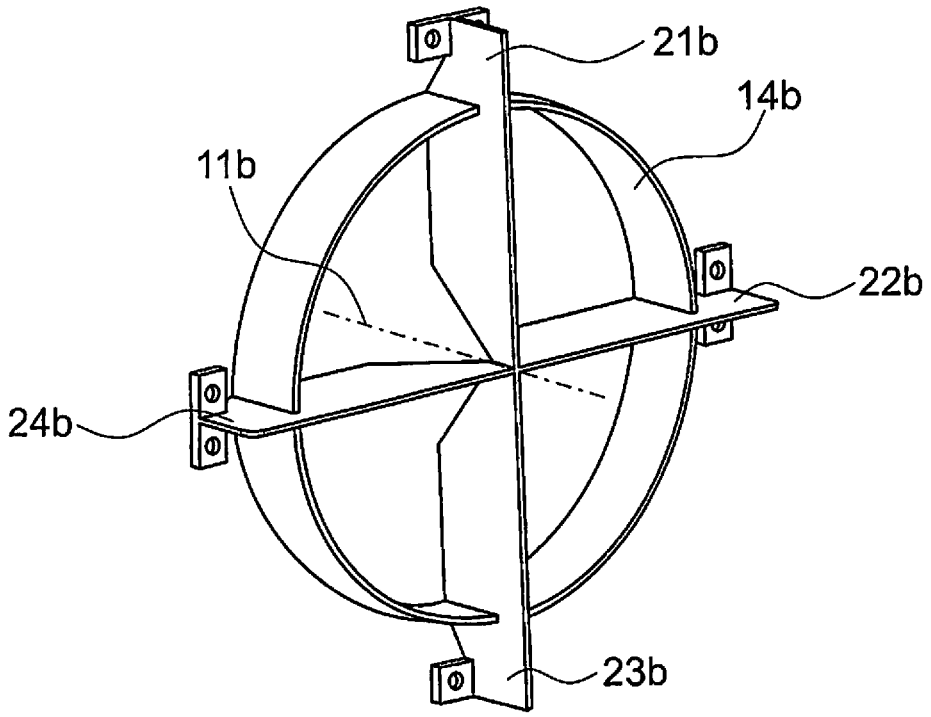
FIG. 5 is an embodiment of a flow guiding element having fastening elements which are arranged in the shape of a cross.
Figure 6:
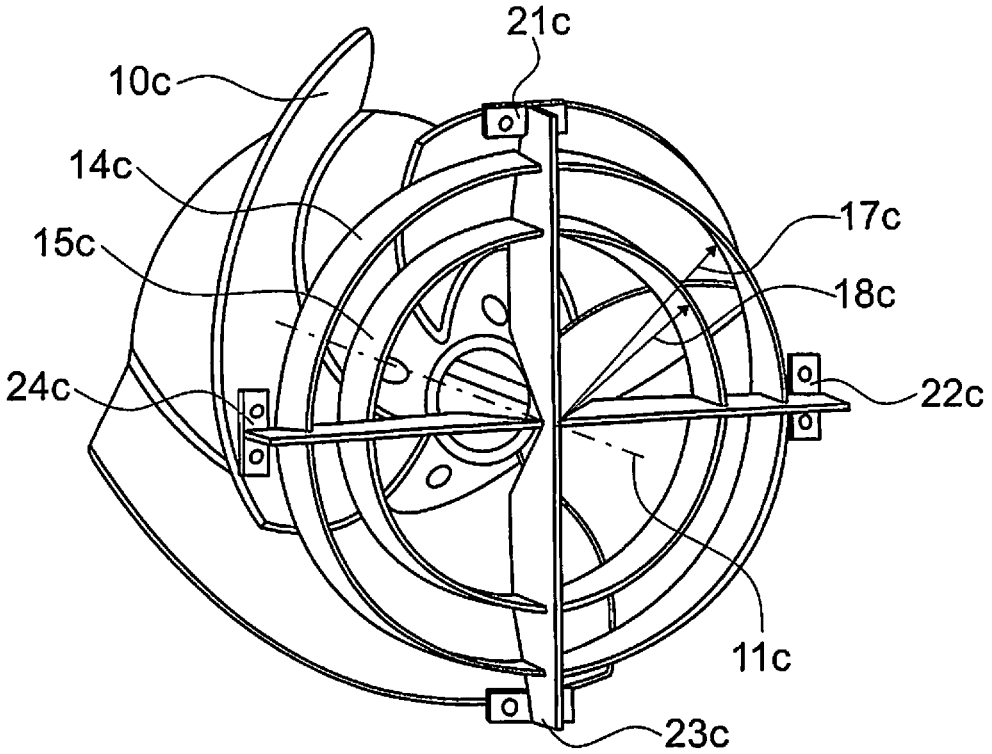
FIG. 6 is an embodiment having two concentrically arranged flow guiding elements.

In the FIGS. 5 and 6 two further embodiments of the invention are shown. The subsequent description is limited substantially to the differences between the embodiments, wherein one can refer to the description of the other embodiments with respect to equal components, features and functions, in particular to that of FIGS. 1 to 4. For differentiating the embodiments, the letter a is used in the reference numerals of the embodiment shown in the FIGS. 1 to 4 and is respectively replaced by the letters b and c with respect to the reference numerals of the embodiments of FIGS. 5 and 6. With respect to the same reference to the components, in particular with respect to components having the same reference numerals, one can generally refer also to the drawing and/or the description of the other embodiments, in particular to that of FIGS. 1 to 4.

The FIG. 5 shows a flow guiding element 14*b* having fastening elements 21*b*, 22*b*, 23*b*, 24*b* for a pumping apparatus in accordance with the invention which differentiates, in particular with respect to the fastening elements 21*b*, 22*b*, 23*b*, 24*b* from the embodiment illustrated in FIG. 1. The flow guiding element 14*b* corresponds to the previously mentioned embodiment. In contrast to the previous embodiment the fastening elements 21*b*, 22*b*, 23*b*, 24*b* are centrally joined and arranged radially with respect to an axis of rotation 11*b* of an impeller not illustrated in detail. The fastening elements 21*b*, 22*b*, 23*b*, 24*b* thereby form a cross which acts as a suction protection for the impeller.

The FIG. 6 shows a pumping apparatus having two flow guiding elements 14*c*, 15*c*, as well as having fastening elements 21*c*, 22*c*, 23*c*, 24*c*. The fastening elements 21*c*, 22*c*, 23*c*, 24*c* are configured in analogy to the previous embodiment. The fastening elements 21*c*, 22*c*, 23*c*, 24*c* which are radially arranged with respect to an axis of rotation 11*c* of an impeller are centrally joined in the form of a cross which acts as a suction protection for the impeller 10*c*.

The two flow guiding elements 14*c*, 15*c* are arranged coaxial with respect to one another. The outer flow guiding element 14*c* corresponds to the embodiment of the FIGS. 1 to 3. The second flow guiding element 15*c* differentiates, in particular with respect to its radius of curvature from a radius of curvature 17*c* of the first flow guiding element 14*c*. In analogy to the first flow guiding element 14*c*, also the second flow guiding element 15*c* is configured in the shape of a ring. The radius of curvature 18*c* of the second flow guiding element 15*c* is significantly smaller than the radius of curvature 17*c* of the first flow guiding element 14*c*. A factor between the larger radius of curvature 17*c* and the smaller radius of curvature 18*c* can in this connection lie between 0.2 and 0.8. In the illustrated embodiment it amounts to approximately 0.7.

Generally also a design with more than two flow guiding elements is plausible. Preferably the flow guiding elements are arranged coaxially in the form of rings. In this connection, in particular an arrangement of all flow guiding elements in a plane is advantageous.

What is claimed is:

1. A pumping apparatus comprising:

an impeller rotationally supported about an axis of rotation, being configured to convey a pumpable medium and discharge the pumpable medium in a direction having a major component thereof parallel to the axis of the rotation;

an inlet housing spanning a suction region upstream of the impeller and partially spanning a pump region in which the impeller is arranged, and forming a constriction between the pump region and the suction region upstream of the impeller, the pump region extending from the constriction so as to have an increasing diameter at least partially upstream of the impeller, and the constriction having a diameter that is less than both a diameter of the pump region and a diameter of the suction region; and at least one flow guiding element at least partly arranged within the suction region, and further arranged to guide the medium flowing in an axial direction of the impeller, the suction region being provided to guide the medium flowing in the axial direction of the impeller so as to discharge the medium into the pump region, the at least one flow guiding element including at least one ring segment and being at least partially disposed in the constriction, and a spacing defining a distance being present between the inlet housing and the at least one flow guiding element that is less than a radial distance of the flow guiding element from the axis of rotation.

2. A pumping apparatus in accordance with claim 1, wherein the flow guiding element is arranged coaxial with respect to the axis of rotation.

3. A pumping apparatus in accordance with claim 1, wherein the flow guiding element has a radius of curvature smaller than a maximum radius of the impeller.

4. A pumping apparatus in accordance with claim 1, wherein the flow guiding element is a sheet metal component.

5. A pumping apparatus in accordance with claim 4, wherein the flow guiding element has a height directed along the axis of rotation of the impeller, the height being smaller than a radius of curvature of the flow guiding element.

6. A pumping apparatus in accordance with claim 4, wherein the flow guiding element is in the form of a cylinder jacket surface.

7. A pumping apparatus in accordance with claim 4, wherein the inlet housing is a suction nozzle connected upstream of the impeller from a flow point of view, and the at least one flow guiding element being at least partly arranged in the suction nozzle.

8. A pumping apparatus in accordance with claim 7, wherein the inlet housing has at least one constantly tapering part region forming the suction nozzle, the flow guiding element being at least partly arranged in the at least one constantly tapering part region.

9. A pumping apparatus in accordance with claim 4, wherein the at least one flow guiding element and the inlet housing have a constant spacing at least in a cross-sectional plane perpendicular with respect to the axis of rotation of the impeller.

10. A pumping apparatus in accordance with claim 4, wherein at least one fastener connecting the flow guiding element to the inlet housing.

11. A pumping apparatus in accordance with claim 10, wherein the at least one fastener extends in at least one substantially radial direction with respect to the axis of rotation of the impeller.

12. A pump comprising:

a pumping apparatus comprising an impeller rotationally supported about an axis of rotation, being configured to convey a pumpable medium and discharge the pumpable in a direction having a major component thereof parallel to the axis of rotation;

an inlet housing spanning a suction region upstream of the impeller and partially spanning a pump region in which the impeller is arranged, and forming a constriction between the pump region and the suction region upstream of the impeller, the pump region extending from the constriction so as to have an increasing diameter at least partially upstream of the impeller, and the constriction having a diameter that is less than both a diameter of the pump region and a diameter of the suction region; and at least one flow guiding element at least partly arranged within the suction region, and further arranged to guide the medium flowing in an axial direction of the impeller, the suction region being provided to guide the medium flowing in the axial direction of the impeller so as to discharge the medium into the pump region, the at least one flow guiding element including at least one ring segment and being at least partially disposed in the constriction, and a spacing defining a distance being present between the inlet housing and the at least one flow guiding element that is less than a radial distance of the flow guiding element from the axis of rotation.

* * * * *